US006161808A

United States Patent [19]

East et al.

[11] Patent Number: 6,161,808

[45] Date of Patent: Dec. 19, 2000

[54] KNOCKDOWN SUPPORT STAND

[75] Inventors: Dion A. East; Kevin H. Page, both of Hixon; Hollinger L. Morton, III, Chattanooga, all of Tenn.

[73] Assignee: American Manufacturing Company, Chattanooga, Tenn.

[21] Appl. No.: 09/280,911

[22] Filed: Mar. 29, 1999

[51] Int. Cl.[7] ..... A45D 19/04

[52] U.S. Cl. ..... 248/175; 248/165; 248/440; 211/189

[58] Field of Search ..... 248/175, 165, 248/440, 440.1, 188.1, 150; 108/156, 155, 157.16, 158.11; 211/181.1, 189

[56] References Cited

U.S. PATENT DOCUMENTS

| | | | |
|---|---|---|---|
| D. 172,594 | 7/1954 | Guichard | D6/499 |
| D. 240,436 | 7/1976 | Rosenberg . | |
| D. 243,027 | 1/1977 | Young et al. . | |
| 1,386,878 | 8/1921 | Lamp . | |
| 1,612,903 | 10/1927 | Bitney | 211/85 |
| 1,612,937 | 10/1927 | Mitchell | 108/59 |
| 2,469,698 | 5/1949 | Morgan | 248/165 |
| 2,707,664 | 5/1955 | Marsilius . | |
| 2,746,823 | 5/1956 | Sand | 248/165 |
| 2,768,044 | 10/1956 | Jaffe . | |
| 2,794,496 | 6/1957 | Strand, Jr. | 248/165 |
| 2,813,576 | 11/1957 | Mayer | 248/165 |
| 3,997,139 | 12/1976 | Young et al. . | |
| 5,921,513 | 7/1999 | Skvorecz | 248/153 |

*Primary Examiner*—Anita M. King
*Assistant Examiner*—Naschica Sanders
*Attorney, Agent, or Firm*—Pitts & Brittian, P.C.

[57] ABSTRACT

A knockdown support stand for support of aquarium or terrarium-type containers of varying capacities. The stand includes a plurality of support members depending from the bottom surface of a substantially planar top of the stand. Each support member includes first and second resiliently bendable and twistable legs which are joined together at their bottom ends. The legs each include an upper end which is permanently bent at ninety degrees to the longitudinal centerline of the leg and within the plane commonly occupied by the first and second legs. This bent end is further permanently bent at an angle of forty-five degrees in a direction out of the plane commonly occupied by the legs. A plurality of pairs of receivers are attached to the bottom surface of the top at spaced intervals about the periphery of the top. The receivers of each pair are oriented with their extended longitudinal centerlines intersecting at a right angle at a location inwardly of the periphery of the top and of the pair of receivers. Through manual manipulation including bending and twisting of the legs, the bent ends of the legs are aligned with their respective receivers and inserted into the tubes. Upon release, the legs tend to relax, whereupon the bent ends frictionally engage the inner wall of their respective receivers to bind the bent ends securely within their receivers. In one embodiment, a support shelf is interposed between the several support, the support shelf being dimensionally larger than the top so as to urge the support members outwardly from the vertical.

13 Claims, 6 Drawing Sheets

KNOCKDOWN SUPPORT STAND

FIELD OF INVENTION

The present invention relates to display support stand, and more particularly to an apparatus and a method of assembly for a knockdown support stand having self-attaching support members.

BACKGROUND OF INVENTION

Numerous aquarium stands have been developed to support aquariums and terrariums. Prior aquarium stands have included rigid rails and frames that may be assembled for support of aquariums, but may not be disassembled easily into a relatively flat package for storage and transport. In addition, prior stands may require bolting or other attachment methods for multiple frame members to provide structural rigidity to support heavy display containers. Other prior stands rely on the horizontal or vertical spring tension of the attached legs connecting to frame brackets to provide adequate pressure for retention of the legs in an upper frame bracket. When bumped or shaken, prior attachment mechanisms tend to disengage, break down, and spill the contents of a supported container.

Accordingly, it is an object of the present invention to provide a knockdown support stand especially for weighty objects.

It is another object of the present invention to provide a method of assembly of a support stand.

It is another object of the present invention to provide a plurality of rigid support legs connected to a support top with the legs held in place by frictional forces providing interconnection to the support top.

SUMMARY OF INVENTION

In accordance with one aspect of the present invention, a knockdown support stand is provided for support of weighty objects such as aquarium and terrarium containers, the support stand including a support top preferably having a polygonal shape. The support top includes a generally planar upper surface for supporting a weighty object, an outer rim, and a substantially planar bottom surface. The top is supported by a plurality of support members each of which includes at least two resiliently bendable and twistable support legs, each leg having an end which is insertable into a tubular receiver mounted on the bottom surface of the top. A generally planar support shelf attachable between the support legs when the support legs are attached to the top may be provided. The support shelf preferably is dimensionally larger than the lateral spacing between the several support members. A plurality of pairs of hollow tubular receivers are fixedly secured to the bottom surface of the top, each pair of receivers being spaced at intervals along the outer rim, preferably one receiver of each corner of the top. Each receiver of the legs of each pair of receivers adapted to detachably accept the upper ends of the legs of a respective support member. For assembly of the support stand, the upper ends of the legs are resiliently spread apart, twisted inwardly, and inserted at the same time into their respective pair of receivers. Upon release of the torsion and tension which is necessarily introduced to the support leg during assembly of the leg with the top of the stand, each of the ends of the leg frictionally engages the interior wall of their respective receiver to frictionally interconnect the support member with the top, without the use of fasteners or other connectors.

BRIEF DESCRIPTION OF DRAWINGS

Various objects and advantages of the present invention will be readily apparent from the description contained herein, including the claims and the drawings, in which:

DETAILED DESCRIPTION OF INVENTION

Figure 1:
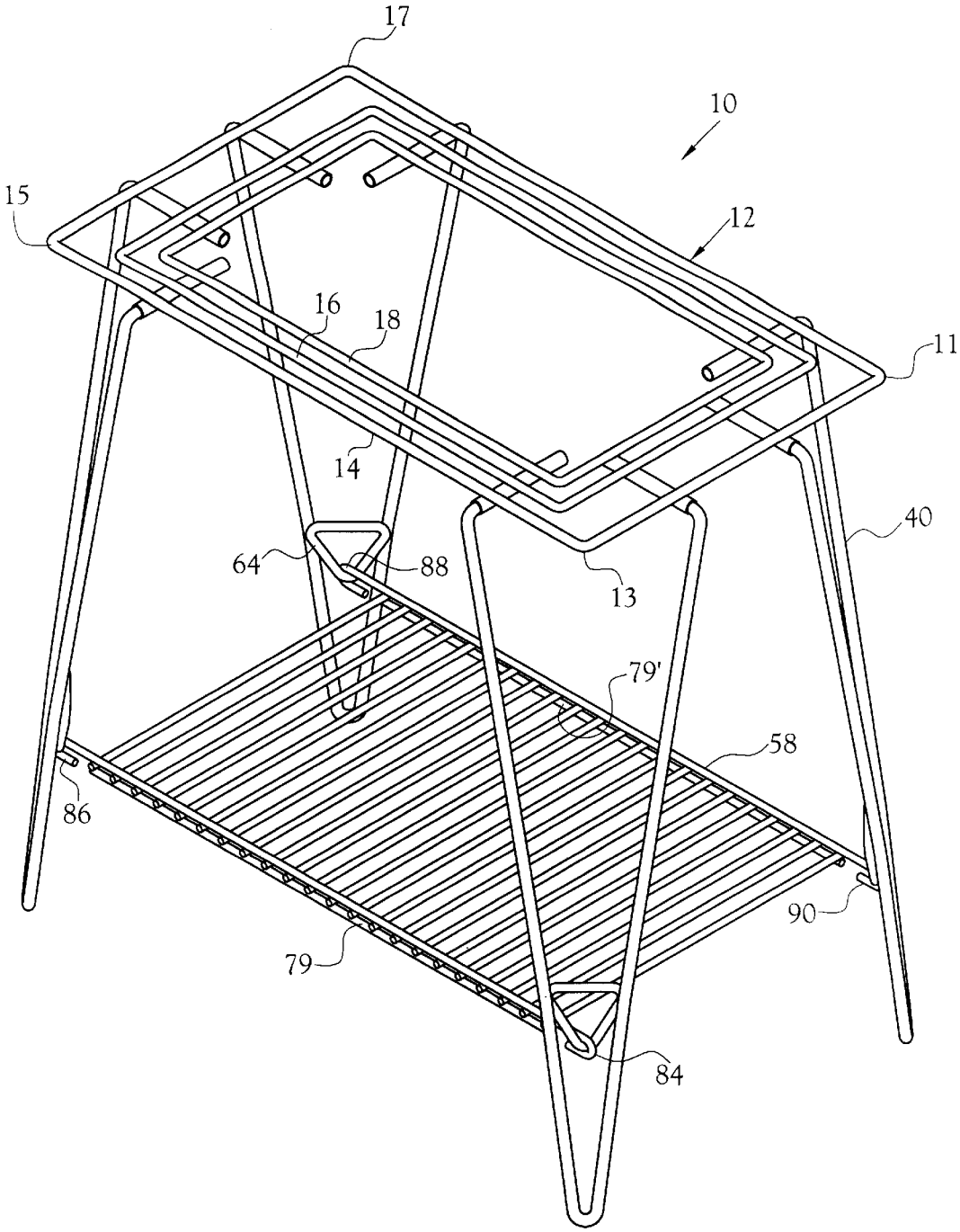
FIG. 1 is a perspective view of one embodiment of the assembled knockdown support stand according to the present invention.

In FIGS. 1–12, there is depicted one embodiment of a knockdown support stand embodying various of the features of the present invention. The depicted embodiment comprises a support stand 10 designed to support weighty containers of varying capacities such as an aquarium or terrarium display container. The support stand 10 is of the knockdown type, and may be readily packaged in shipping containers having generally flat rectangular dimensions for transporting and storage, and which may be readily assembled without tools or extraneous fasteners or the like.

As depicted several in FIGS. 1–9, the support stand 10 comprises a four-sided support top 12, four identical support members 40, and a lower shelf 58. Upon assembly of the components of the invention, the knockdown support stand 10 provides improvements in the connection and inherent stability of the interconnected components without the use of bolts or other fasteners. Cooperative interconnection of various components of the present stand provides rigid frictional interconnections between the support members and the top . As a result of the design of these interconnections, once the stand is assembled and a weighty object is supported on the top, the frictional interconnections are enhanced.

The support stand 10 may be multi-sided, i.e., a polygonal configuration having three or more sides. A four sided configuration, generally rectangular is preferred. The depicted stand includes a generally planar top 12 and four support members 40, one each of which is disposed at each of the four corners 11, 13, 15, and 17 of the top. For other geometry tops the number of support members may coincide with the number of corners of the stand 10. The depicted four-sided planar top 12 includes a rectangular outer rim 14 defining, the perimeter of the top 12, with a congruent four-sided middle rod 16 oriented within the outer rim 14. A further congruent four-sided inner rod 18 oriented within the middle rod 16 combines with the rim 14 and middle rod 16 to define a generally planar, top 12 which includes sides 19, 21, 23 and 25. The dimensions of the preferred outer circumference of the rectangular shaped support top 12 may range widely, but commonly a rectangular top may range from approximately eighteen inches in length and approximately eight inches in width, to approximately twenty-five inches in length and approximately thirteen inches in width. The rim 14, middle support rod 16, and inner support rod 18 may be composed of solid or hollow metal, fiberglass, or other generally rigid tubing material that has adequate strength to support a large size aquarium or terrarium containing approximately ten, twenty or more gallons of water, sand, and other materials commonly associated with aquariums. Alternatively, the components of the top 12 may be fabricated from hollow tubes or solid rods, or a combination thereof, depending on the desire for weight reduction for shipping of the knockdown support stand 10, and the need for rigidity and support of large heavy display containers when the support stand 10 is assembled and in use. It is of importance in the present invention that the top be sufficiently rigid as will provide for rigid fixed mounting of a plurality of support members to the bottom surface 39 of the top. To this end, in the depicted embodiment of FIG. 1, each of the receivers is welded as at 41, 42 and 43 (typical) to each of the outer, middle and inner rods of the depicted top. A screen mesh or a solid sheet of cover material of metal or other generally rigid material may cover the upper surface of the top 12, as desired or needed for support purposes. As desired, the entire top may comprise a solid metal sheet.

The present invention further includes multiple pairs of generally cylindrical tubular receivers 20/22, 24/26, 28/30, and 32/34. In the depicted embodiment of FIG. 1 the multiple pairs of insertion tubes 20/22, are mounted with their respective longitudinal centerlines perpendicular to respective adjacent sides of the top and oriented parallel to the horizontal bottom planar surface 39 defined by the outer rim 14, middle support rod 16, and inner support rod 18 of the top 12, for example. Each of the receivers is welded or otherwise rigidly and fixedly mounted to the bottom surface of the top 12 and adjacent the side margins of their respective adjacent sides of the top. In one embodiment, each receiver tube extends laterally outwardly from the periphery of the top to overhang the outer rim 14. In the depicted embodiment, each receiver of a pair of receivers is located approximately four to five inches inward from the corner defined by their respective sides 21, 23, for example, of the top 12.

Figure 2:
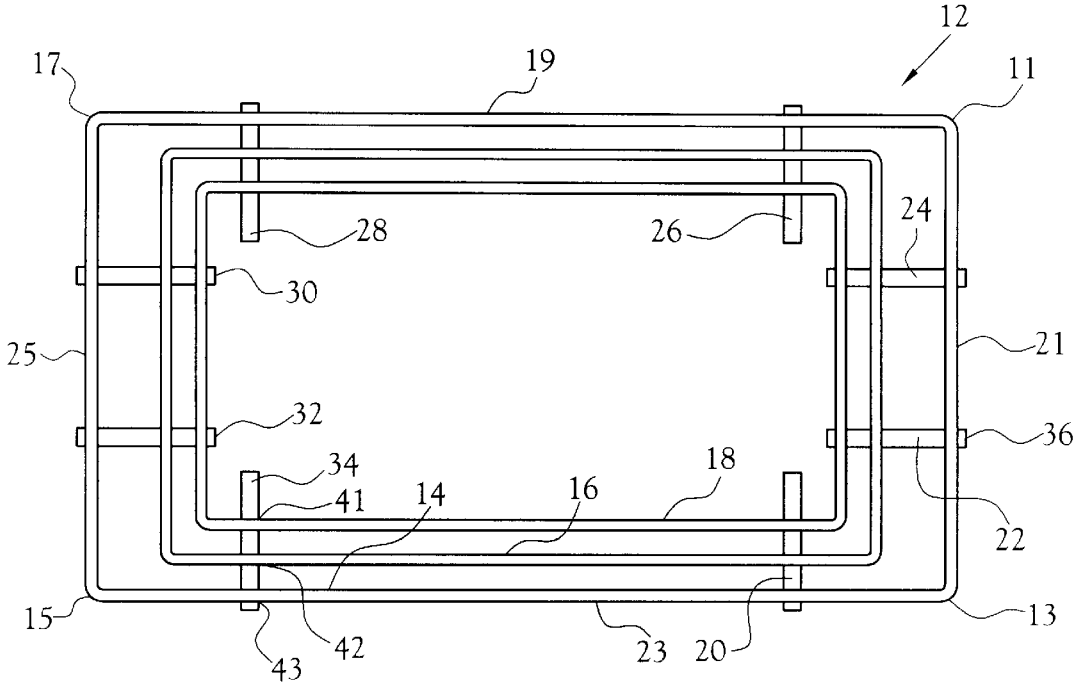
FIG. 2 plan view of a support top of the embodiment depicted FIG. 1.
Figure 3:
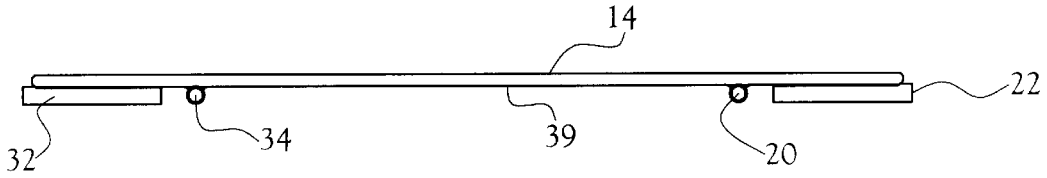
FIG. 3 is a side view of the support top depicted in FIG. 2.

As shown in FIG. 2, individual ones of a first pair of tubular receivers 20/22 are disposed on adjacent sides 21, 23 of a first corner 13 of the top 12. Each receiver has an outwardly extending open end 36. The opposed, inboard end 37 of each receiver may be either open or closed, as desired. A preferred receiver is a hollow straight cylinder. This receiver is preferably of substantially uniform wall thickness so that the interior wall 38 thereof is substantially cylindrical. In one suitable embodiment, each receiver has an internal diameter of about 0.404 inch and, each bent end has an outer diameter of about 0.3625 inches.

Figure 10:
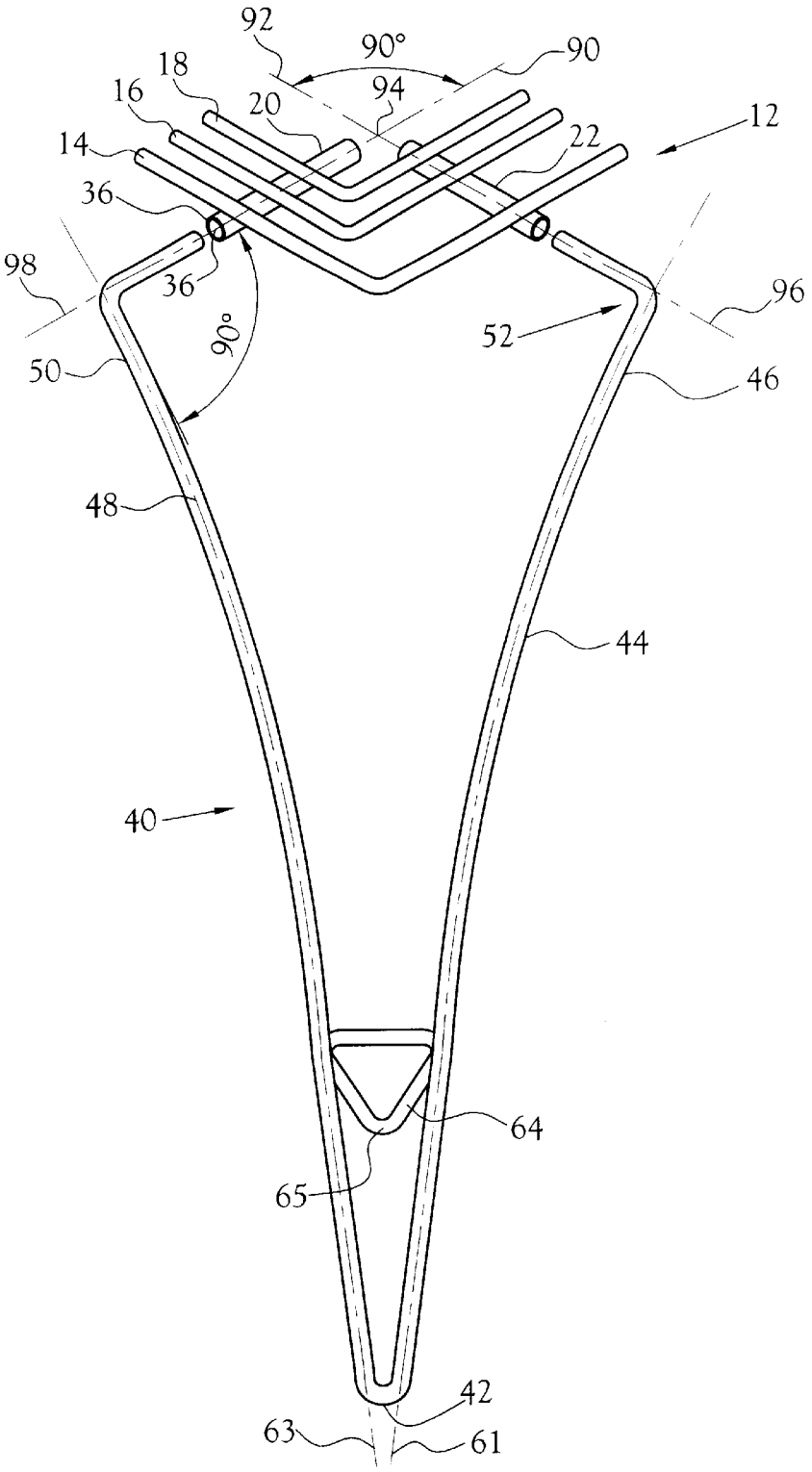
FIG. 10 is a partial perspective view of a corner area of the support stand depicted in FIG. 1 and depicting the assembly of a support member to the top of the stand depicted in FIG. 1.
Figure 11:
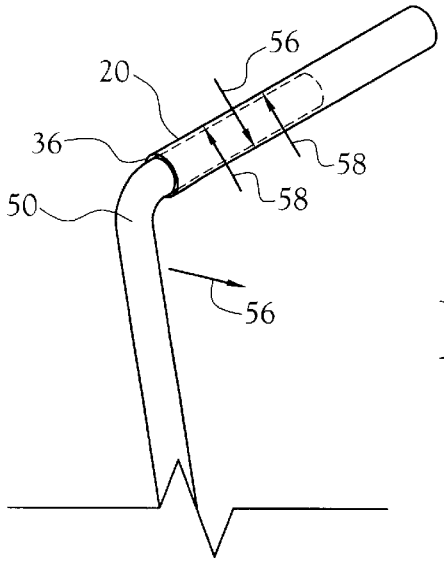
FIG. 11 is a perspective view of the top end of a leg of a support member after insertion of the end into a tubular receiver and, depicting the horizontal forces exerted by the end of the leg on the interior wall of a tubular receiver of the present invention.
Figure 12:
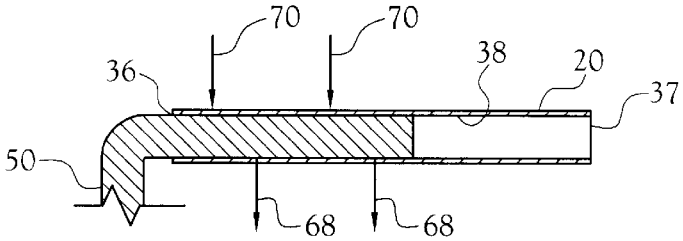
FIG. 12 is a side view, partly cutaway of one end of a leg of a support member following its insertion into a receiver tube, and depicting the vertical forces exerted by the end on the interior wall of a tubular receiver of the present invention.

As depicted in FIG. 10, in accordance with one aspect of the present invention, the longitudinal centerlines 90, 92 of the receivers 20, 22 of each pair of receivers are oriented with respective centerlines intersect at a right angle at a location 94 which is disposed inwardly from the perimeter of the top 12 and also inwardly of the receivers themselves. As further described herein, this orientation of the receivers of each pair of receivers functions in combination with geometry of each support member and the angularity of each of the bent ends of the legs of each support member to require manipulation of the legs of the support member to the extent that the longitudinal centerlines 96, 98 of the bent ends are in alignment with the longitudinal centerlines of their receivers in order to insert the bent ends of a given support member into a respective pair of receivers, and to develop a system of frictional engagement of the bent ends within their respective receivers upon their release from their manipulated state.

Figure 4:
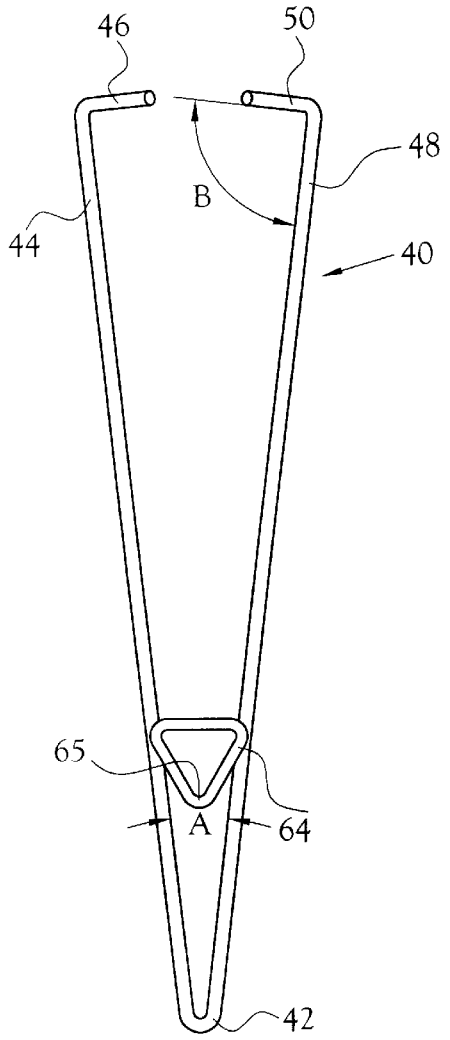
FIG. 4 is a plan view of the inwardly facing side of a support member as depicted in FIG. 1.
Figure 5:
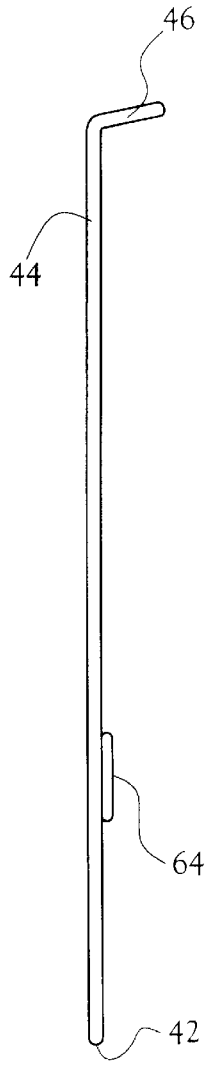
FIG. 5 is a side view of the support member depicted in FIG. 4.
Figure 6:
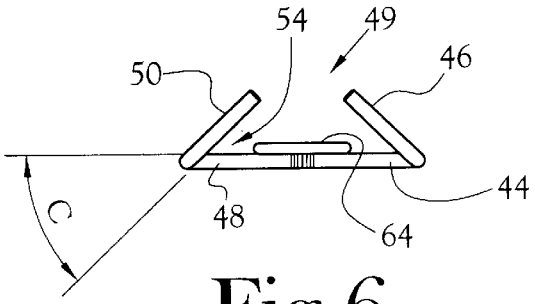
FIG. 6 is a top end view of the support member depicted in FIG. 4.

As shown in FIGS. 4–6, each support member 40, is formed with two uprightly oriented legs 44, 48 extending upward from a lower connecting end 42 which is designed to rest on a supporting surface, such as a floor or the like. The number of support members may be the same as the number of corners of the polygonal top 12, with a minimum of three support members required for adequate support of a top in the absence of some added lateral support for each support member, such as a horizontal plate or cross member affixed to the bottom end of each support member. Commonly, each support member 40 may have an overall length of approximately twenty-eight inches. With reference to FIGS. 4–6, the left-hand leg 44 of each support member 40 is a resiliently bendable and twistable, preferably solid metal rod, connecting at the lower end 42 thereof to the right-hand leg 48. Each leg has a generally cylindrical cross-section, may be manufactured of approximately 20 gauge cold-rolled steel, ASTM A510M, and have an outer diameter of about 0.3625 inch for most applications of the stand. The two legs form two sides of an open triangle having an angle between the members 44, 48 of approximately thirteen degrees as indicated by the arrow "A". A pair of bent ends 46, 50 define the upper ends of of the legs 44, 48 (FIG. 4). The two bent ends 46, 50 are not connected together to form a closed triangular shape; rather, the ends 46,50 are spaced apart from one another by a distance which allows the ends to be manipulated for insertion into a respective pair of receivers. The left-hand end 46 and right-hand end 50 are each bent at an approximately 90° angle indicated by the arrow "B" of FIG. 4, outward from the plane formed by the legs 44,48 and the lower end 42, as shown in FIGS. 4–6. The left-hand end 46 and right-hand end 50 of the legs 44,48 are also each bent at an approximately 45° angle indicated by the arrow "C" of FIG. 6 in a direction inwardly toward each other, leaving a gap 49 between the bent ends 46, 50, as shown in FIGS. 4 and 6. The 90° bend 52 and 45° degree bend 54 ,in addition to the limited resiliency of the legs 44,48, allow the ends 46, 50 of each support member 40,to be manually manipulated to the limited extent required for simultaneous insertion of the two bent ends into their respective receivers 20, 22 located on either side of a generally right angled corner B of a four-sided top 14 (FIG. 10). If a different shaped polygonal support top 14 is utilized, such as a three, five, six, or other sided top, then the 45° degree bend 54 maybe adjusted to a smaller angle for a three-sided top, or to a larger angle for a five, six, or other sided top.

Figure 13:
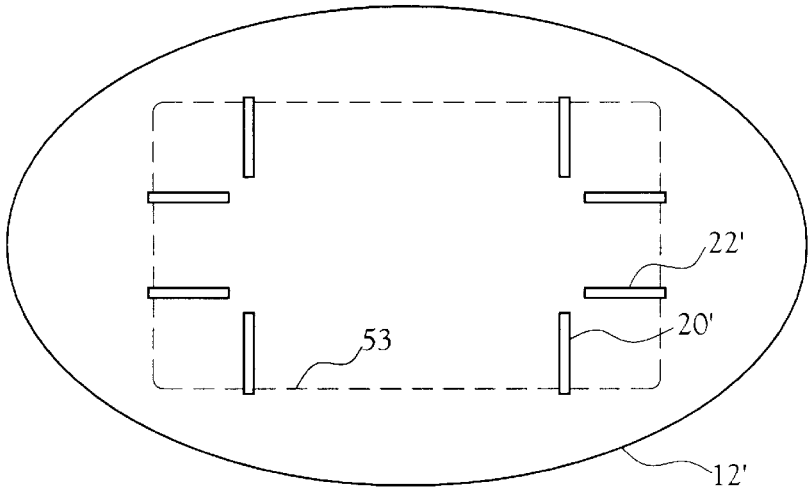
FIG. 13 is a representation, in plan view, of an alternative embodiment of a top for a stand of the present invention.

In one embodiment of the present invention, the top of the stand may be circular or oval in geometry. In this embodiment, as depicted in FIG. 13, the tubular receivers 20', 22' may be fixedly mounted to the bottom surface of the top 12'. The orientation of the several, in the depicted embodiment four, pairs of receivers is like the orientation of the receivers employing with a rectangular top, for example, in that the receivers are aligned with the extensions of their respective longitudinal centerlines intersecting at a right angle at a location inwardly of the receivers. In FIG. 13, the dotted line depicts an imaginary rectangular outline 53, about the periphery of which the several pairs of receivers are disposed.

Each support member 40 of the present stand includes a shelf bracket 64 (typical) extending between and fixedly mounted to its opposite legs 44,48 at a location intermediate the bottom end 42 the bent ends 46,50 thereof, preferably at a location nearer the bottom end 42. In one embodiment, the shelf bracket is disposed within about nine inches from the bottom end 42 of a twenty-eight inch long support member. Each bracket, as depicted in the several Figures, comprises a solid metal rod formed into a closed triangular geometry. Each bracket preferably is disposed in a plane which is parallel and adjacent to the plane occupied by the legs of the support member with one leg of the triangular bracket extending horizontally between the two legs of the support member so that the apex of the triangle opposite this horizontal leg is oriented toward the bottom of the leg and is substantially centered between the legs at this location. In this manner, the apex 65 of the bracket serves to receive thereon one corner 63 of a shelf 60. In one suitable embodiment, this apex of the bracket may be located about six inches above the bottom end 42 of the support member 40.

Figure 7:
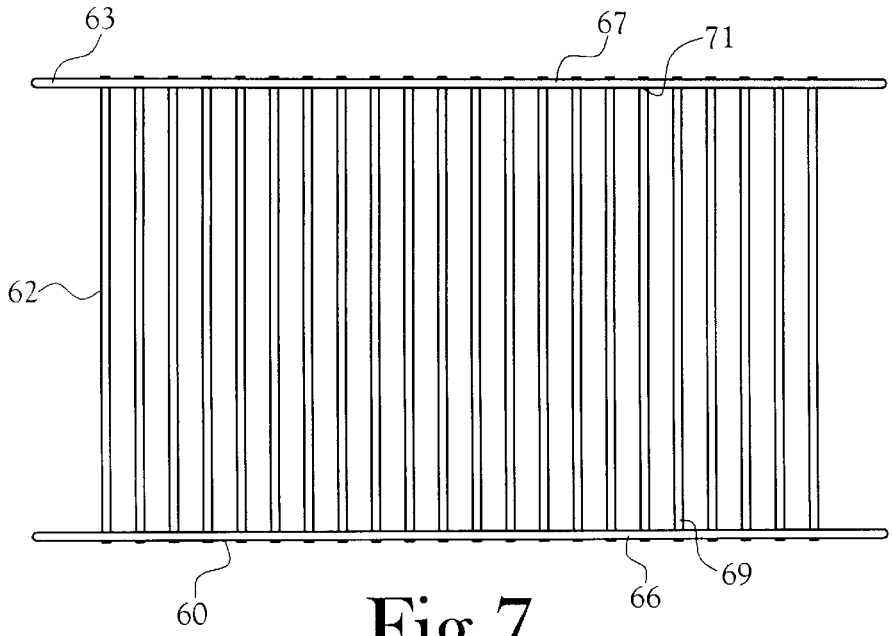
FIG. 7 is a top plan view of a shelf suitable for receipt between the support members depicted in FIG. 1.
Figure 8:
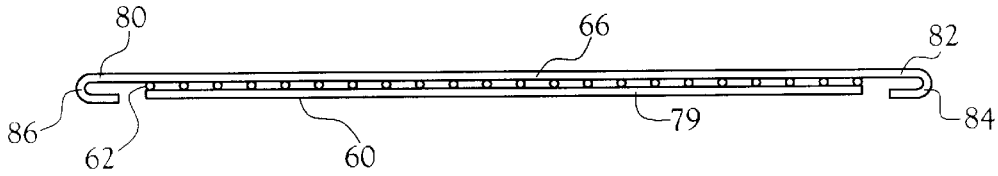
FIG. 8 deas view of the shelf depicted in FIG. 7.
Figure 9:
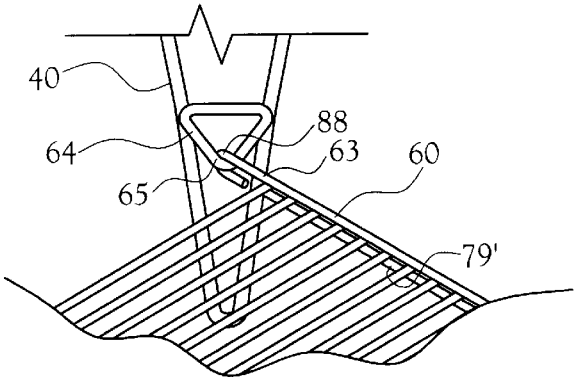
FIG. 9 is a perspective view depicting one embodiment for mounting corner of a shelf to a support member.

As shown in FIGS. 7–9, a preferred embodiment of the present stand includes a rigid lower planar shelf 60 that has a shape i.e., rectangular geometry, generally the same as the shape of the support top 12. In the depicted embodiment, the shelf comprises first and second opposite side rails 66,67 and a plurality of parallel cross-members 62 extending between the side rails. The opposite ends 69,71 (typical) of the depicted cross-members 62 are fixedly secured to the respective side rails as by welding or the like. A reinforcing rod 79 may be welded to the lower surfaces of the ends 69 of the cross members, as desired. A like reinforcing rod 79 may be similarly welded to the ends 71 of the cross members 62. Each of the opposite ends 80 and 82 of each of the side rails 66 and 67 is provided with a hook configuration 84,86,88, 90. Each such hook is configured to receive therein a shelf bracket so that the shelf is mounted at each of its corners to a shelf bracket associated with each of the support members 40. Once a shelf bracket is received within the hook, the hook may be closed to capture the shelf bracket therein and fixedly mount the shelf in a horizontal attitude between the support members and generally parallel to the top 12. In one embodiment, the shelf may be of a slightly, e.g., about 1–2 inches, greater in length and width than the top 12. When the shelf is mounted between the several support members 40 of the stand, the slightly larger dimensions of the shelf 60 force the lower end 42 of each support leg 40 outwardly from the vertical to establish a slightly larger footprint for the support stand 10.

In accordance with the present invention, the angles of the bent ends 46, 50, of each leg and the location and orientation of a respective pair of receivers 20, 22 on either side of a corner 13 provide for manual manipulation of each leg of the stand for proper assembly of the support member 40 into a respective pair of receivers 20, 22. This manual manipulation requires that a person grasp the left-hand end 46, and the right-hand end 50 in their hands, resiliently spread the support members 44, 48 apart at their upper ends, and simultaneously rotate the legs about their respective longitudinal centerlines 61,63 in a direction toward alignment with the longitudinal centerlines 90,92 of the irrespective receivers by an amount sufficient to align the bent ends with their respective receivers, hence in position for the insertion of the bent ends into these receivers. The action of spreading apart the upper ends of the legs introduces into each a leg a tension force which tends to urge the legs toward one another, hence toward their respective receivers. In similar manner the action of rotating the ends 46, 50 introduces a torsional force 58 to each of the rotated ends 46, 50, which tends to urge the bent ends to rotate about the longitudinal centerline of their respective leg.

Once the bent ends of the legs have been manually manipulated and axially aligned with their respective receivers, the bent ends are inserted into their receivers and the legs are released. Upon their release, the legs tend to return toward their neutral tension and torsional states. By reason of the lack of sufficient clearance between the outer diameter of each of the bent legs and the inner diameter of their respective receivers, the legs are prohibited from fully relaxing and returning to their neutral state. Instead, the bent ends frictionally engage the inner wall of their respective receivers and become frictionally bound within their receiver tubes.

An additional and third force in the form of a lateral lever-type force 68 is imposed upon each leg by reason of the leg being spread laterally outwardly of the stand upon the mounting of the shelf 60 between the several support legs 40 after the bent ends 46, 50 are inserted into their respective receiver tubes 20, 22 (See FIG. 8–9). This force manifests itself as further frictional engagement of the bent ends of the legs with the inner wall of their respective receivers.

A further and fourth force is generated by the downwardly directed weight of an aquarium or terrarium mounted on the support top 12. This latter force serves to enhance the tension force which is imposed on each leg by the less-than-fully relaxed legs and thereby enhances the degree of frictional engagement of the bent ends with the inner walls of their respective receiver tubes The summation of the forces of the tension 56, the torsional force 58, and the lever-type force 68, are created by the configuration and alignment of the bent ends 46, 50, relative to the longitudinal centerline of each leg as the bent ends are inserted into their respective insertion tubes 20/22, 24/26, 28/30, 32/34 , along with the configuration of each support member 40 and the orientation of the centerlines of the respective receivers. The forces 56, 58, 68, created by the assembled elements of the invention, along with the downward force 70 of an aquarium or terrarium, provide a connective mechanism which is readily established without the aid of tools or extraneous fasteners and which assures continued frictional attachment of each support leg 40. The present knockdown support stand may be disassembled in reverse order, i.e. removing the lower shelf 60, and detaching each pair of bent ends 46, 50 for each support leg 40, thereby providing a collection of elements that may be packed into a flat package for movement and reassembly, or for storage in a small area, or for shipment in a flat and stackable package.

The present invention further provides a method for the assembly of a knockdown stand for a weighty object such as an aquarium wherein the stand includes a substantially planar top having an outer perimeter and a bottom surface, a plurality of support members adapted to frictionally engage a plurality of receiver tubes mounted on the bottom surface of the stand, each support member including first and second resilient legs that are joined at their bottom ends and extend divergently upwardly from their joined bottom ends and terminate in respective outboard bent ends, the first and second legs occupying a common plane comprising the steps of mounting a plurality of pairs of hollow tubular receivers at spaced apart location on the bottom surface of the top, each of the receivers adapted to receive therein one of the bent ends of each leg of the support member and having a longitudinal centerline, each receiver being oriented with its centerline aligned substantially normal to the outer perimeter of the top and with the extension of its longitudinal centerline intersecting at a right angle the extension of the longitudinal centerline of the other of the pair of receivers at a location inwardly of the locations of the receivers and of the perimeter of the top, permanently bending the outboard end of each leg of a support member at an angle of about 90 degrees to the longitudinal centerline of the leg and within the plane occupied by the legs and in a direction toward the other of the legs of the support member and further permanently bending the outboard end of each leg of the support member at an angle of about 45 degrees out of the plane occupied by the legs, manually manipulating the bent ends of each leg of a support member by resiliently bending the leg in a direction to spread apart the legs of the support member and place each leg in tension, and simultaneously twisting each leg by an amount sufficient to align each of the bent ends with the longitudinal centerline of a respective one of a pair of receivers for positioning the bent ends for insertion into a respective one of the pair of receivers, the twisting action placing each leg in torsion, inserting the manipulated and aligned bent ends into respective ones of the pair of receivers, and thereafter, releasing the tension and torsional forces which were imposed on each leg during manipulation thereof, whereby each bent end frictionally engages the inner wall of its respective receiver.

In one embodiment of the method each bent end frictionally engages the inner wall of its respective receiver tube at multiple locations within its respective receiver.

In a further embodiment, the method includes the step of interposing a substantially planar shelf between a plurality of support members which are attached to the top, the shelf being dimensioned such as to cause each support member to be urged laterally outwardly from a vertical attitude such that each support member is inclined outwardly from its mounting location on the bottom surface of the top.

ALTERNATIVE EMBODIMENTS

The knockdown support stand 10 may be of any multi-sided configuration, circular, oval or polygon shaped, for example, with a polygon support top 12 having three, four, five, or more sides. In all instances, the longitudinal centerlines of the receivers 20, 22 are oriented with their extended longitudinal centerlines intersecting at a right angle inwardly of the planar top and of the receivers themselves. The 90° angle of each pair of bent ends 46, 50 remains the same for all embodiments. The 45° angle bend of inward turn of each pair of the bent ends 46, 50 for a multi-sided top, is adjusted as necessary to permit manual manipulation of each leg sufficient to align the bent ends with their respective receivers for insertion of the bent ends into their receivers. It will be recognized that the receivers may be mounted on the bottom surface of the top at locations which are spaced inwardly of the perimeter of the top so long as the receivers of each pair of receivers are oriented with their respective longitudinal centerlines oriented with their longitudinal centerlines intersecting at a right angle and at a location more inwardly of the top than the receivers themselves.

As noted hereinabove, the support stand 10 may be composed of metal or other rigid material including wood, fiberglass, or graphite composite materials capable of supporting the weight of approximately 10 to 20 or more gallons of water and/or sand, and associated equipment commonly utilized on or within an aquarium or terrarium container.

Whereas one skilled in the art will recognize variations and associated embodiments such as different support stand shapes and material compositions upon a reading of the above specification with reference to the Figures, the foregoing description is exemplary in nature, and the invention is to be limited only as set forth in the claims appended hereto.

What is claimed:

1. A knockdown support stand comprising:

a top having an upper surface, a periphery, and a substantially planar bottom surface;

a plurality of support members releasably attached to and depending from said bottom surface; each support member including first and second legs each having a longitudinal centerline and which are joined at their bottom ends and extend upwardly from said joined bottom ends independently of one another, each leg terminating at its upper end in the form of a bent end, each of said legs being resiliently bendable and twistable about their respective centerline;

a plurality of pairs of tubular receivers secured to said bottom surface of said top, each receiver including a longitudinal centerline, said centerline of each receiver of a pair of receivers being oriented with the extensions of their respective longitudinal centerlines intersecting at a right angle at a location inwardly of said perimeter and inwardly of said pair of receivers, said plurality of pairs of receivers being spaced at intervals along said perimeter of said support top, one of said receivers of each pair of receivers being adapted to receive therein one of said upper bent ends of said legs of a support member when the longitudinal centerline of each of said bent ends is manipulated by resiliently flexing each leg to space the legs of a support member apart from one another and by resiliently twisting each leg to rotate its respective bent end to thereby align the longitudinal centerlines of said bent end with the longitudinal centerlines of respective ones of a pair of said receiver tubes;

whereby upon insertion of said bent ends of each leg of a support member into respective ones of said pair of receiver tubes and release of the manipulative forces on said legs, said legs tend to return to a relaxed state causing said bent ends to frictionally engage the inner walls of their respective receivers and secure said bent ends against withdrawal of said bent ends from their respective receivers.

2. The knockdown support stand of claim 1, wherein each of said receivers comprises a hollow straight cylinder having a substantially uniform wall thickness and an internal diameter greater than the outer diameter of a respective one of said bent ends by an amount which provides for secure frictional engagement of said bent ends within said receiver upon release of said manipulative force imposed upon said bent end.

3. The knockdown support stand of claim 1 wherein said top is generally planar and rectangular in geometry and a support member is secured to the bottom surface of said top adjacent each of the corners thereof by a pair of receivers, one of which is disposed on adjacent sides of each corner of said top.

4. The knockdown support stand of claim 1, wherein each of said support members is of an open triangular geometry defined by said first and second legs and their respective bent ends, said bent ends being spaced apart from one another by a distance which is insufficient to permit insertion of said bent ends into respective ones of a pair of receiver tubes when said legs are in a relaxed state.

5. The knockdown support stand of claim 4, and including a shelf bracket fixedly secured to each of said support members at a location adjacent the bottom end of said support member.

6. The knockdown support stand of claim 5 and including a generally planar shelf interposed between the plurality of support members attached to and depending from said bottom surface of said top, said shelf being dimensioned to urge the bottom ends of said support members outwardly from the vertical whereby each of said support members is inclined outwardly from said top when said shelf is in position between said support members.

7. The knockdown support stand of claim 1, wherein each of said upper bent ends is bent inwardly toward an opposite one of said legs at about angle of about 90 degrees relative to the longitudinal centerline of respective ones of said legs and within the plane occupied by said legs.

8. The knockdown support stand of claim 7, wherein each of said upper bent ends is additionally bent in the same direction out of the plane occupied by said legs at an angle of about 45 degrees.

9. The knockdown support stand of claim 1, wherein said upper bent ends, when inserted into said receivers and released from their manipulated states, frictionally engage the inner wall of their respective receiver at multiple locations along the length of said respective receiver.

10. The knockdown support stand of claim 1, wherein each of said receivers is approximately 0.404 inch in internal diameter and each of said bent ends of said legs has an outer diameter of about 0.3625 inch.

11. A method for the assembly of a knockdown stand for a weighty object such as an aquarium wherein the stand includes a substantially planar top having an outer perimeter and a bottom surface, a plurality of support members including first and second resilient legs that are joined at their bottom ends and extend divergently upwardly from their joined bottom ends and terminate in respective outboard bent ends, the first and second legs occupying a common plane comprising the steps of mounting a pair of hollow tubular receivers on the bottom surface of the top, each of said receivers adapted to receive therein one of the bent ends of each leg of the support member and having a longitudinal centerline, each receiver being oriented with the extension of its longitudinal centerline intersecting at a right angle the extension of the longitudinal centerline of the other of the pair of receivers at a location inwardly of the perimeter of the top and inwardly of the receiver themselves, permanently bending the outboard end of each leg of a support member at an angle of about 90 degrees to the longitudinal centerline of the leg and within the plane occupied by the legs and in a direction toward the other of the legs of the support member and further permanently bending the outboard end of each leg of the support member at an angle of about 45 degrees out of the plane occupied by the legs, manually manipulating the bent ends of each leg of a support member by resiliently bending the leg in a direction to spread apart the legs of the support member and place each leg in tension, and simultaneously twisting each leg by an amount sufficient to align the longitudinal centerline of each of the bent ends with the longitudinal centerline of a respective one of a pair of receivers for positioning the bent ends for insertion into a respective one of the pair of receivers, said twisting action placing each leg in torsion, inserting said manipulated and aligned bent ends into respective ones of the pair of receivers, thereafter, releasing the tension and torsional forces which were imposed on each leg during manipulation thereof, whereby each bent end frictionally engages the inner wall of its respective receiver.

12. The method of claim 11 where each bent end frictionally engages the inner wall of its respective receiver at multiple locations within its respective receiver tube.

13. The method of claim 11 and including the step of interposing a substantially planar shelf between a plurality of support members which are attached to the top, said shelf being dimensioned such as to cause each support member to be urged laterally outwardly from a vertical attitude such that each support member is inclined outwardly from its mounting location on the bottom surface of the top.

* * * * *